US008849151B2

(12) United States Patent
Shimizu et al.

(10) Patent No.: US 8,849,151 B2
(45) Date of Patent: Sep. 30, 2014

(54) PHOTOSENSITIVE MEMBER UNIT

(71) Applicants: Takashi Shimizu, Nakagawa-ku (JP); Koji Abe, Minami-ku (JP); Junichi Hashimoto, Toyohashi (JP)

(72) Inventors: Takashi Shimizu, Nakagawa-ku (JP); Koji Abe, Minami-ku (JP); Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 92 days.

(21) Appl. No.: 13/623,321

(22) Filed: Sep. 20, 2012

(65) Prior Publication Data

US 2013/0164023 A1 Jun. 27, 2013

(30) Foreign Application Priority Data

Dec. 26, 2011 (JP) ..... 2011-284421

(51) Int. Cl.
*G03G 15/02* (2006.01)
*G03G 21/00* (2006.01)
*G03G 21/18* (2006.01)

(52) U.S. Cl.
USPC ..... 399/100; 399/110; 399/112; 399/113

(58) Field of Classification Search
USPC ..... 399/100, 110, 111, 112, 113, 123, 92
See application file for complete search history.

(56) References Cited

U.S. PATENT DOCUMENTS

| | | | | |
|---|---|---|---|---|
| 4,788,573 | A * | 11/1988 | Nakaoka et al. | 399/100 |
| 7,555,235 | B2 | 6/2009 | Okabe et al. | |
| 8,369,734 | B2 * | 2/2013 | Shimizu et al. | 399/100 |
| 2004/0013443 | A1 * | 1/2004 | Itoh et al. | 399/100 |
| 2007/0036577 | A1 | 2/2007 | Okabe et al. | |
| 2011/0222897 | A1 * | 9/2011 | Makino | 399/92 |
| 2012/0002999 | A1 * | 1/2012 | Itabashi | 399/100 |

FOREIGN PATENT DOCUMENTS

| | | | |
|---|---|---|---|
| JP | 2006-145588 A | * | 6/2006 |
| JP | 2007-072420 A | | 3/2007 |

* cited by examiner

*Primary Examiner* — Sophia S Chen
(74) *Attorney, Agent, or Firm* — Banner & Witcoff, Ltd.

(57) ABSTRACT

A photosensitive member unit includes: a first image forming unit including a first photosensitive member rotatable on a first axis line; and a second image forming unit including a second photosensitive member rotatable on a second axis line parallel with the first axis line and disposed in parallel with the first image forming unit at a first side in an orthogonal direction perpendicular to the first and second axis lines. The first image forming unit includes a charger and a cartridge containing portion. The charger includes: a charging member; a cleaning member for cleaning the charging member; and an operating member for operating the cleaning member. The operating member is inoperable when the developing cartridge is installed in the cartridge containing portion, and is exposed to be operable in the cartridge containing portion when the developing cartridge is removed from the cartridge containing portion.

17 Claims, 12 Drawing Sheets

PHOTOSENSITIVE MEMBER UNIT

CROSS-REFERENCE TO RELATED APPLICATIONS

This application claims priority from Japanese Patent Application No. 2011-284421 filed on Dec. 26, 2011, the entire subject matter of which is incorporated herein by reference.

TECHNICAL FIELD

The present invention relates to a photosensitive member unit for an image forming apparatus using an electrophotographic system.

BACKGROUND

As electrophotographic image forming apparatuses, there have been proposed color printers each of which includes a tandem type photosensitive member unit having a plurality of photosensitive members and a plurality of developing units.

As an example of these color printers, there have been proposed a laser printer which includes a drum unit having four photosensitive drums corresponding to individual colors and four developing units corresponding to the individual photosensitive drums.

In this laser printer, the drum unit includes scorotron type chargers corresponding to the individual photosensitive drums. Each scorotron type charger includes a wire cleaner for cleaning a charger wire.

SUMMARY

Illustrative aspects of the present invention provide a photosensitive member unit capable of cleaning a charging member easily.

Therefore, according to one illustrative aspect of the present invention, there is provided a photosensitive member unit comprising: a first image forming unit comprising a first photosensitive member that is rotatable on a first axis line; and a second image forming unit comprising a second photosensitive member, which is rotatable on a second axis line parallel with the first axis line, and which is disposed in parallel with the first image forming unit at a first side in an orthogonal direction perpendicular to the first axis line and the second axis line, wherein the first image forming unit comprises: a charger facing the first photosensitive member; and a cartridge containing portion, which faces the first photosensitive member, and which is configured to contain a developing cartridge that is configured to feed developer to the first photosensitive member such that the developing cartridge is removably mounted, wherein the charger comprises: a charging member configured to receive a predetermined voltage; a cleaning member configured to clean the charging member, and an operating member configured to operate the cleaning member, wherein the operating member is configured to be inoperable when the developing cartridge is installed in the cartridge containing portion, and wherein the operating member is exposed to be operable in the cartridge containing portion when the developing cartridge is removed from the cartridge containing portion.

BRIEF DESCRIPTION OF THE DRAWINGS

FIGS. 7A to 7C are explanatory views illustrating the operation of the wire cleaner shown in FIG. 4, in which FIG. 7A shows a state before the wire cleaner is operated (e.g., a state where an operating member is at a standby position, and the duct cover is at an abutting position), FIG. 7B shows a state where the wire cleaner has started to move from the standby position to the right side, and FIG. 7C shows a state where the wire cleaner has moved further to the right side from the state of FIG. 7B (e.g., a state where the operating member is at a cleaning position, and the duct cover is at a separation position);

FIGS. 8A to 8C are explanatory views illustrating a wire cleaner of a second exemplary embodiment, in which FIG. 8A shows a state before the wire cleaner is operated (e.g., a state where an operating member is at a standby position, and a duct cover is at an abutting position), FIG. 8B shows a state where the wire cleaner has started to move from the standby position to the right side, and FIG. 8C shows a state where the wire cleaner has moved further to the right side from the state of FIG. 7B (e.g., a state where the operating member is at a cleaning position, and a duct wall is at a separation position);

FIGS. 9A and 9B are explanatory views illustrating a wire cleaner of a third exemplary embodiment, in which FIG. 9A is a perspective view illustrating the wire cleaner as seen from the top front side, and FIG. 9B is an enlarged view of a main portion illustrating relative disposition of a developing cartridge and the wire cleaner at a standby position; and FIGS. 10A and 10B are explanatory views illustrating a wire cleaner of a fourth exemplary embodiment, in which FIG. 10A shows a state before the wire cleaner is operated (e.g., a state where an operating member is at a standby position, and a duct shutter is at a closed position), and FIG. 10B shows a state where the wire cleaner has moved from the standby position to the right side (e.g., a state where the operating member is at a cleaning position, and the duct shutter is at an open position).

DETAILED DESCRIPTION

<General Overview>

Figure 1:
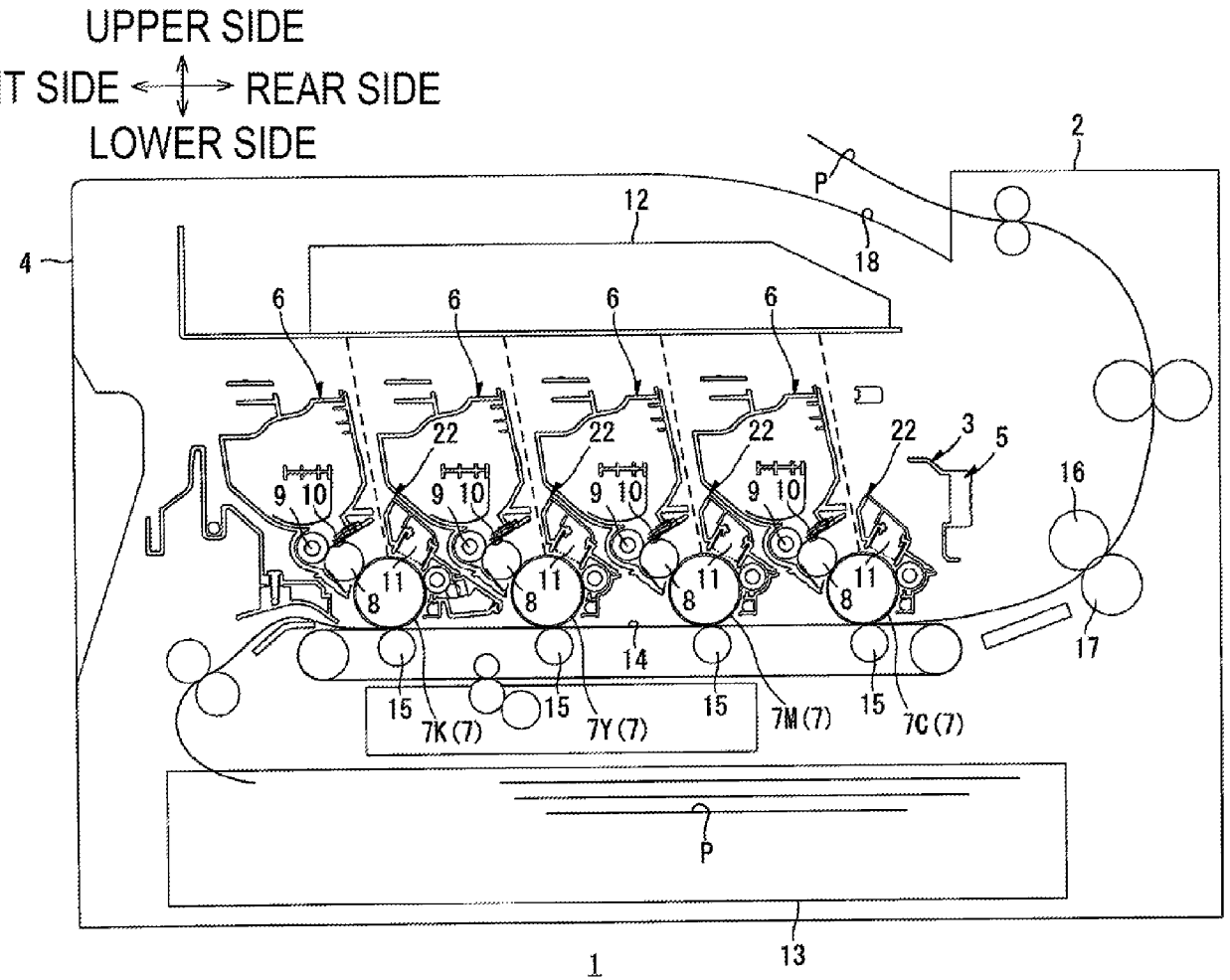
FIG. 1 is a cross-sectional view illustrating a printer including a drum unit according to a first exemplary embodiment of a photosensitive member unit of the present invention.

However, in the above-described related-art laser printer, a holding portion of each wire cleaner faces a developing unit corresponding to a photosensitive drum on the right side of a corresponding photosensitive drum, that is, a developing unit corresponding to a different color.

For this reason, in order to clean a charger wire, it is necessary to operate a wire cleaner after removing a developing unit corresponding to a different color. Therefore, the operation of each wire cleaner may be difficult to be understood and may be complicated.

Illustrative aspects of the present invention provide a photosensitive member unit capable of cleaning a charging member easily.

According to a first illustrative aspect of the present invention, there is provided a photosensitive member unit comprising: a first image forming unit comprising a first photosensitive member that is rotatable on a first axis line; and a second image forming unit comprising a second photosensitive member, which is rotatable on a second axis line parallel with the first axis line, and which is disposed in parallel with the first image forming unit at a first side in an orthogonal direction perpendicular to the first axis line and the second axis line. The first image forming unit comprises: a charger facing the first photosensitive member; and a cartridge containing portion, which faces the first photosensitive member, and which is configured to contain a developing cartridge that is configured to feed developer to the first photosensitive member such that the developing cartridge is removably mounted. The charger comprises: a charging member configured to receive a predetermined voltage; a cleaning member configured to clean the charging member; and an operating member configured to operate the cleaning member. The operating member is configured to be inoperable when the developing cartridge is installed in the cartridge containing portion, and the operating member is exposed to be operable in the cartridge containing portion when the developing cartridge is removed from the cartridge containing portion.

According thereto, the operating member of the charger corresponding to the first photosensitive member is exposed to be operable when the developing cartridge corresponding to the first photosensitive member is removed from the cartridge containing portion.

Therefore, by removing a developing cartridge corresponding to the first photosensitive member corresponding to the charger which is a cleaning object, it is possible to clean the charging member of the charger.

As a result, it is possible to more easily clean the charging member as compared to a case of cleaning the charging member after removing a developing cartridge corresponding to the second photosensitive member different from the first photosensitive member.

According to a second illustrative aspect of the present invention, the operating member comprises an operating portion configured to face the developing cartridge when the developing cartridge is installed in the cartridge containing portion.

According thereto, it is possible to certainly expose the operating portion of the charger by removing the developing cartridge from the cartridge containing portion.

According to a third illustrative aspect of the present invention, the charger has a first opening formed across the charging member from the first photosensitive member. The first image forming unit comprises a venting portion that is connected to the first opening. The operating portion is disposed across the venting portion from the charger.

According thereto, it is possible to make air act on the charger through the venting portion.

According to a fourth illustrative aspect of the present invention, the operating member comprises: a cleaning-member supporting portion that supports the cleaning member; and a connecting portion that connects the operating portion and the cleaning-member supporting portion. The connecting portion is disposed in the venting portion.

According thereto, it is possible to use the venting portion to efficiently dispose the connecting portion for connecting the cleaning-member supporting portion and the operating portion.

According to a fifth illustrative aspect of the present invention, the operating member is configured to be movable between a standby position where the operating member is located when the operating member is not operated and a cleaning position where the operating member is located when the operating member is operated, along an axis line direction parallel with the first axis line and the second axis line. The venting portion has a second opening formed to be opened toward a second side in the orthogonal direction. The second opening is configured to be closed when the operating member is disposed at the standby position, and the second opening is configured to be opened when the operating member moves from the standby position to the cleaning member.

According thereto, it is possible to open the second opening at the same time as the operating member moves from the standby position to the cleaning position.

Therefore, unless the cleaning of the charging member is performed, it is possible to maintain the sealability of the venting portion. Also, when the cleaning of the charging member is performed, it is possible to secure the movement path of the connecting portion.

According to the sixth illustrative aspect of the present invention, the venting portion comprises: a first wall which comprises a first end edge; and a second wall which comprises a second end edge facing the first end edge. The first wall is configured to be disposed at an abutting position where the first end edge abuts on the second end edge when the operating member is disposed at the standby position, and the first wall is configured to move to a separation position where the first end edge is separated from the second end edge when the operating member moves from the standby position to the cleaning position. The second opening is defined by the first end edge and the second end edge when the first wall is disposed at the separation position.

According thereto, it is possible to use the movement of the operating member from the standby position to the cleaning position to move the first wall disposed across the connecting portion from the first photosensitive member, thereby opening the second opening.

Therefore, when the cleaning of the charging member is performed, it is possible to certainly open the second opening, and secure the movement path of the connecting portion.

According to the seventh illustrative aspect of the present invention, the operating member comprises a pressing portion configured to press the first end edge such that the first end edge is separated from the second end edge when the operating member moves from the standby position to the cleaning position.

According thereto, it is possible to certainly separate the first end edge from the second end edge by the pressing portion.

Therefore, when the cleaning of the charger is performed, it is possible to more certainly open the second opening, and secure the movement path of the connecting portion.

According to an eighth illustrative aspect of the present invention, the second end edge is configured to guide the movement of the operating member.

According thereto, it is possible to use the second end edge to guide the operating member, and to improve the operability of the operating member without increasing the number of components.

According to a ninth illustrative aspect of the present invention, the first wall comprises a flow aligning member configured to uniformize an air flow heading from the venting portion to the charger in the axis line direction. The flow aligning member is configured to be disposed to overlap the connecting portion as seen from the axis line direction when the first wall is disposed at the abutting position, and the flow aligning member is configured to be disposed across the connecting portion from the first photosensitive member as seen from the axis line direction when the first wall is disposed at the separation position.

According thereto, it is possible to use the flow aligning member to align the air flow in the venting portion, and to dispose the flow aligning member across the connecting portion from the first photosensitive member so as not to interfere with the connecting portion when the operating member is operated.

Therefore, it is possible to align the air flow in the venting portion while ensuring the operability of the operating member.

According to a tenth illustrative aspect of the present invention, the photosensitive member unit further comprises a pressing member configured to press the first end edge toward the second end edge such that the first end edge abuts on the second end edge.

According thereto, when the operating member is disposed at the standby position, it is possible to certainly dispose the first wall at the abutting position.

According to an eleventh illustrative aspect of the present invention, the venting portion comprises: a first wall which comprises a first end edge; and a second wall which comprises a second end edge facing the first end edge. The second wall is configured to be disposed at an abutting position where the second end edge abuts on the first end edge when the operating member is disposed at the standby position, and the second wall is configured to rotate to a separation position where the second end edge is separated from the first end edge when the operating member moves from the standby position to the cleaning position. The second opening is defined by the first end edge and the second end edge when the second wall is disposed at the separation position.

According thereto, it is possible to use the movement of the operating member from the standby position to the cleaning position to rotate the second wall disposed on the other side to the connecting portion in the orthogonal direction, thereby opening the second opening.

Therefore, when the cleaning of the charging member is performed, it is possible to certainly open the second position and secure the movement path of the connecting portion.

According to a twelfth illustrative aspect of the present invention, the operating member comprises a pressing portion configured to press the second wall such that the second wall is separated from the first wall when the operating member moves from the standby position to the cleaning position.

According thereto, it is possible to certainly separate the second wall from the first wall by the pressing portion.

Therefore, when the cleaning of the charging member is performed, it is possible to more certainly open the second position and secure the movement path of the connecting portion.

According to a thirteenth illustrative aspect of the present invention, the second wall comprises a flow aligning member configured to uniformize an air flow heading from the venting portion to the charger in the axis line direction. The flow aligning member is configured to be disposed to overlap the connecting portion as seen from the axis line direction when the second wall is disposed at the abutting position, and the flow aligning member is configured to be disposed at the second side in the orthogonal direction of the connecting portion as seen from the axis line direction when the second wall is disposed at the separation position.

According thereto, it is possible to use the flow aligning member to align the air flow in the venting portion, and to dispose the flow aligning member on the opposite side to the connecting portion in the orthogonal direction so as not to interfere with the connecting portion when the operating member is operated.

Therefore, it is possible to align the air flow in the venting portion while ensuring the operability of the operating member.

According to a fourteenth illustrative aspect of the present invention, the photosensitive member unit further comprises: a pressing member configured to press the second end edge toward the first end edge such that the second end edge abuts on the first end edge.

According thereto, when the operating member is disposed at the standby position, it is possible to certainly dispose the second wall at the abutting position.

According to a fifteenth illustrative aspect of the present invention, the venting portion comprises: a wall portion, which is disposed at the second side in the orthogonal direction of the connecting portion, and which comprises the second opening; and an opening/closing member, which is connected to the operating member, and which is configured to open and close the second opening. The opening/closing member is configured to be disposed at a closed position where the opening/closing member closes the second opening when the operating member is disposed at the standby position. The opening/closing member moves to an open position where the opening/closing member opens the second opening when the operating member moves from the standby position to the cleaning position.

According thereto, it is possible to use the movement of the operating member from the standby position to the cleaning position to move the opening/closing member from the closed position to the open position, thereby opening the second opening.

Therefore, when the cleaning of the charging member is performed, it is possible to certainly open the second position and secure the movement path of the connecting portion.

According to a sixteenth illustrative aspect of the present invention, the operating portion comprises a protruding portion that protrudes from an end portion on the first photosensitive member side of the operating portion toward the second side in the orthogonal direction.

According thereto, when the operating member is operated, it is possible to use the protruding portion to prevent a finger or the like from coming into contact with the first photosensitive member due to an error of visual estimation or the like.

Therefore, it is possible to easily and certainly operate the operating portion.

According to a seventeenth illustrative aspect of the present invention, the protruding portion is configured to interfere with the developing cartridge when the operating member is disposed offset from the standby position.

According thereto, in a state where the operating member is not at the standby position, since the developing cartridge and the protruding portion interfere with each other, it is impossible to install the developing cartridge into the first image forming unit.

Therefore, in the state where the operating member is not at the standby position, it is possible to suppress the developing cartridge from being installed into the first image forming unit.

As a result, when the developing cartridge is installed into the first image forming unit, it is possible to certainly dispose the operating member at the standby position.

According to the photosensitive member unit of the present invention, by removing the developing cartridge corresponding to the first photosensitive member corresponding to the charger which is a cleaning object, it is possible to clean the charging member of the charger.

As a result, it is possible to more easily clean the charging member as compared to a case of cleaning the charging member after removing a developing cartridge corresponding to the second photosensitive member different from the first photosensitive member.

<Exemplary Embodiments>

Exemplary embodiments of the present invention will now be described with reference to the drawings.

1. Overall Configuration of Printer

As shown in FIG. 1, one example of a printer 1 is a transverse mounted direct tandem type color printer.

In the following description, in cases where directions are referred to, on the basis of a state where the printer 1 is mounted horizontally, the left side of the plane of paper of FIG. 1 is referred to as the front side, and the right side of the plane of paper of FIG. 1 is referred to as the rear side. Also, the left side and the right side are defined on the basis of directions when the printer 1 is viewed from the front side. In other words, the front side of the plane of paper of FIG. 1 is the right side, and the rear side of the plane of paper is the left side.

The printer 1 includes a main body casing 2 having a substantially box shape. At the front end portion of the main body casing 2, a front cover 4 is provided to be openable and closable. The printer 1 includes a processing unit 3 in the main body casing 2. The processing unit 3 is configured to be capable of being taken out of the main body casing 2 in a state where the front cover 4 is open.

The processing unit 3 includes a drum unit 5 (one example of a photosensitive member unit) and a plurality of (e.g., four) developing cartridges 6 which is installed into the drum unit 5 to be removably mounted.

The drum unit 5 includes a plurality of (e.g., four) photosensitive drums 7.

The photosensitive drums 7 are disposed in parallel with intervals in the front/rear direction (e.g., orthogonal direction). Specifically, from the front side toward the rear side, a black photosensitive drum 7K, a yellow photosensitive drum 7Y, a magenta photosensitive drum 7M, and a cyan photosensitive drum 7C are sequentially disposed. The photosensitive drums 7 are formed in a cylindrical shape long in the left/right direction (e.g., axis line direction), and are installed to be rotatable on their central axis lines.

In a first exemplary embodiment, the black photosensitive drum 7K, the yellow photosensitive drum 7Y, or the magenta photosensitive drum 7M are an example of a first photosensitive member, and a central axis line thereof is one example of a first axis line. Also, a photosensitive drum 7 disposed adjacent to the rear side of the black photosensitive drum 7K, the yellow photosensitive drum 7Y, or the magenta photosensitive drum 7M is one example of a second photosensitive member, and a central axis line thereof is one example of a second axis line.

Each of the plurality of developing cartridges 6 is disposed to face the top front side of the respective one of the plurality of photosensitive drums 7. The developing cartridge 6 includes a developing roller 8.

The developing roller 8 is installed to extend in the left/right direction and be exposed from the rear side at the lower end portion of the developing cartridge 6. The developing roller 8 comes into contact with the photosensitive drum 7 from the top front side.

The developing cartridge 6 includes a feeding roller 9 configured feed toner (one example of developer) to the developing roller 8 and a layer-thickness regulating blade 10 configured to regulate the thicknesses of toner fed on the developing roller 8. The developing cartridge 6 is configured to contain the toner at an upper side thereof.

The toner in the developing cartridge 6 is triboelectrically charged to have positive polarity between the feeding roller 9 and the developing roller 8 and is carried as thin layer of a constant thickness on the surface of the developing roller 8.

Meanwhile, the surface of the photosensitive drum 7 is uniformly charged by a scorotron type charger 11 (one example of a charger) disposed to face the top rear side of the photosensitive drum 7. Next, the surface of the photosensitive drum 7 is exposed on the basis of predetermined image data by a laser beam emitted from a scanner unit 12 disposed to face the upper side of the processing unit 3. Therefore, on the surface of the photosensitive drum 7, an electrostatic latent image based on the image data is formed. Next, the toner carried on the developing roller 8 is fed to the electrostatic latent image on the surface of the photosensitive drum 7, whereby a toner image (e.g. developer image) is carried on the surface of the photosensitive drum 7.

Sheets P are contained in a paper feed tray 13 provided at the bottom of the main body casing 2. The sheet is conveyed to make a U turn toward the rear upper side by various rollers, and is fed between the photosensitive drum 7 and a conveyance belt 14, one at a time at predetermined timings. Next, the sheet P is conveyed from the front side toward the rear side by the conveyance belt 14 such that the sheet P sequentially faces all of the photosensitive drums 7. At this time, the toner images carried on the photosensitive drums 7 are transferred onto the sheet P by transfer biases of transfer rollers 15 disposed to face the lower sides of the photosensitive drums 7 with the conveyance belt 14 interposed therebetween.

Then, the sheet P passes through between a heating roller 16 and a pressing roller 17 so as to be heated and pressed. As a result, the toner image is thermally fixed to the sheet P.

Thereafter, the sheet P is conveyed to make a U turn toward the front upper side, and is discharged onto a discharge tray 18 provided at the top of the main body casing 2.

2. Drum Unit

Figure 2:
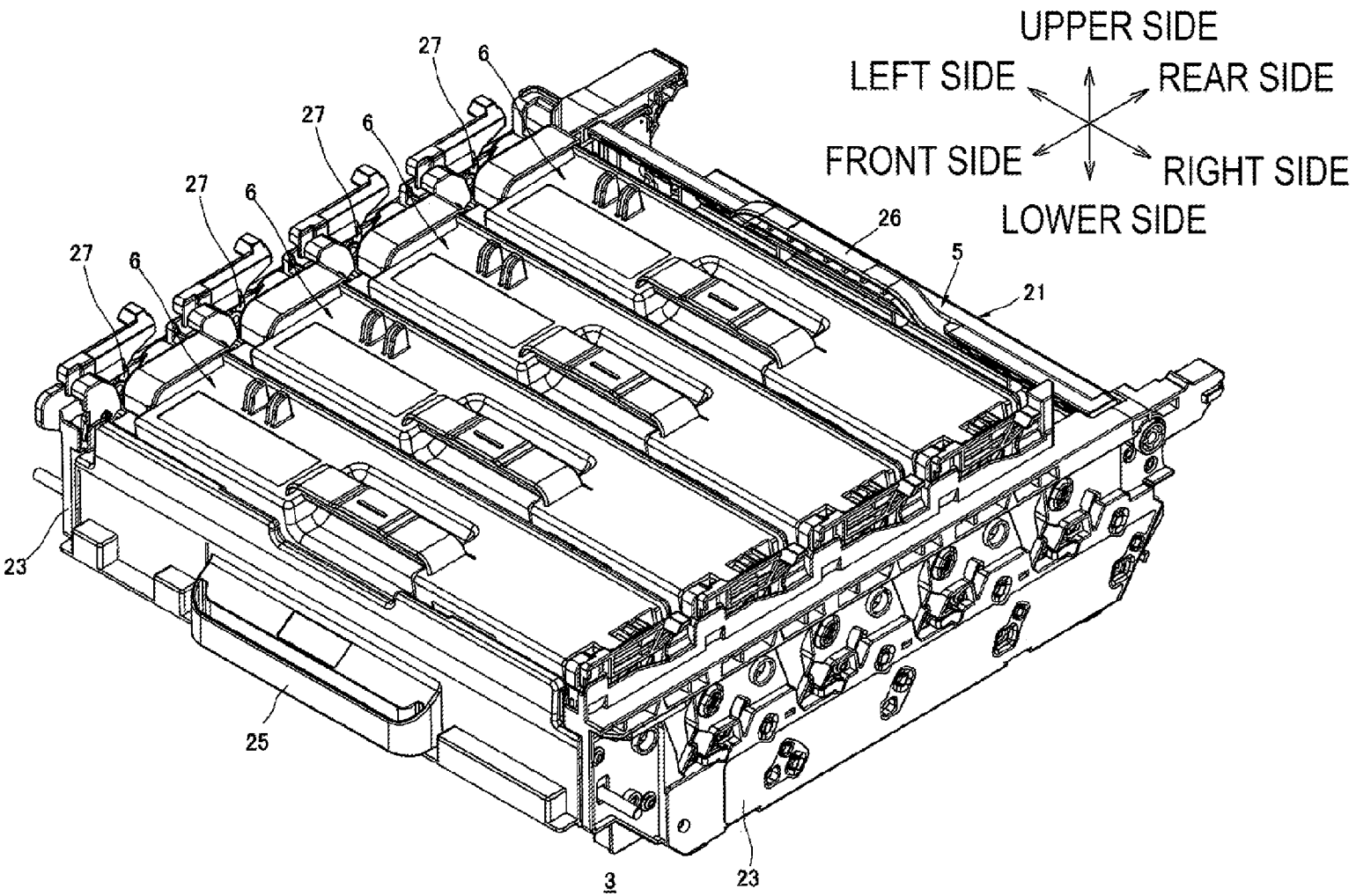
FIG. 2 is a perspective view illustrating a processing unit shown in FIG. 1 as seen from a top front side.
Figure 4:
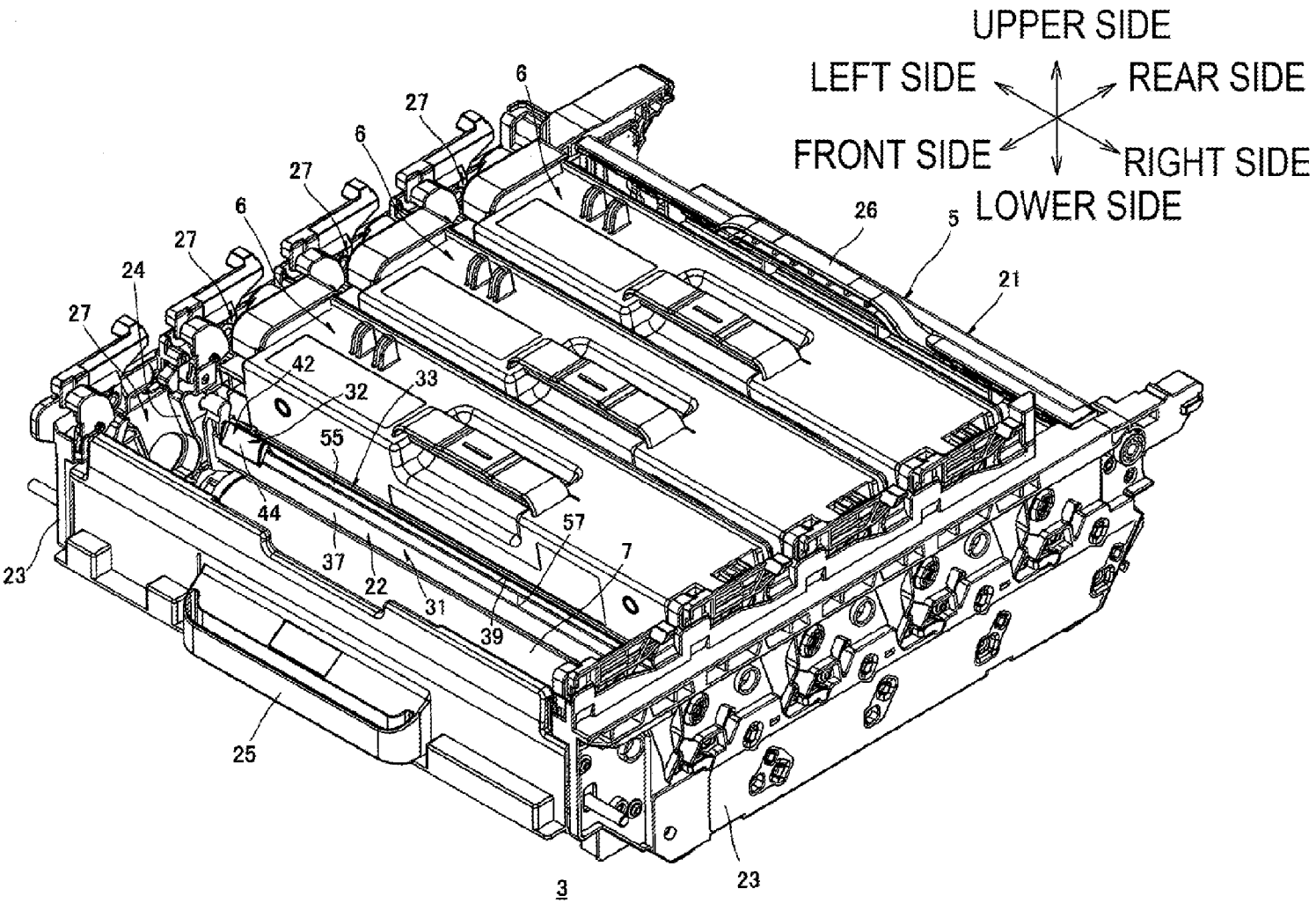
FIG. 4 is a perspective view illustrating the processing unit shown in FIG. 2 as seen from the top front side, and shows a state a black developing cartridge has been removed.

As shown in FIGS. 2 and 4, the drum unit 5 includes a frame 21 and a plurality of (e.g., four) charging units 22.

(1) Frame

The frame 21 is formed in a substantially rectangular frame shape as seen in a plan view. Specifically, the frame 21 includes a pair of left and right side plates 23, a front beam 25, and a rear beam 26.

The two side plates 23 are disposed to face each other with a gap in the left/right direction. The two side plates 23 are formed in a substantially rectangular plate shape long in the front/rear direction as seen in a side view.

Also, at the two side plates 23, guide grooves 24 are formed.

At the inner surface of each side plate 23 in the left/right direction, a plurality of (e.g., four) guide grooves 24 are formed with regular intervals in the front/rear direction to correspond to the plurality of photosensitive drum 7, respectively. Each guide groove 24 is formed in a substantially U shape such that the guide groove 24 extends from the upper portion of a corresponding side plate 23 toward the lower rear side at the top front side of a corresponding photosensitive drum 7 and the upper side of the guide groove 24 is open.

The front beam 25 is formed in a substantially rectangular plate shape extending in the left/right direction as seen in the front view, and extends between the front ends of the two side plates 23.

The rear beam 26 is formed in a substantially rectangular plate shape extending in the left/right direction as seen in the front view. The rear beam 26 extends between the rear ends of the two side plates 23. The rear beam 26 is disposed to face the top rear side of the rearmost charging unit 22.

(2) Charging Unit

Figure 3:
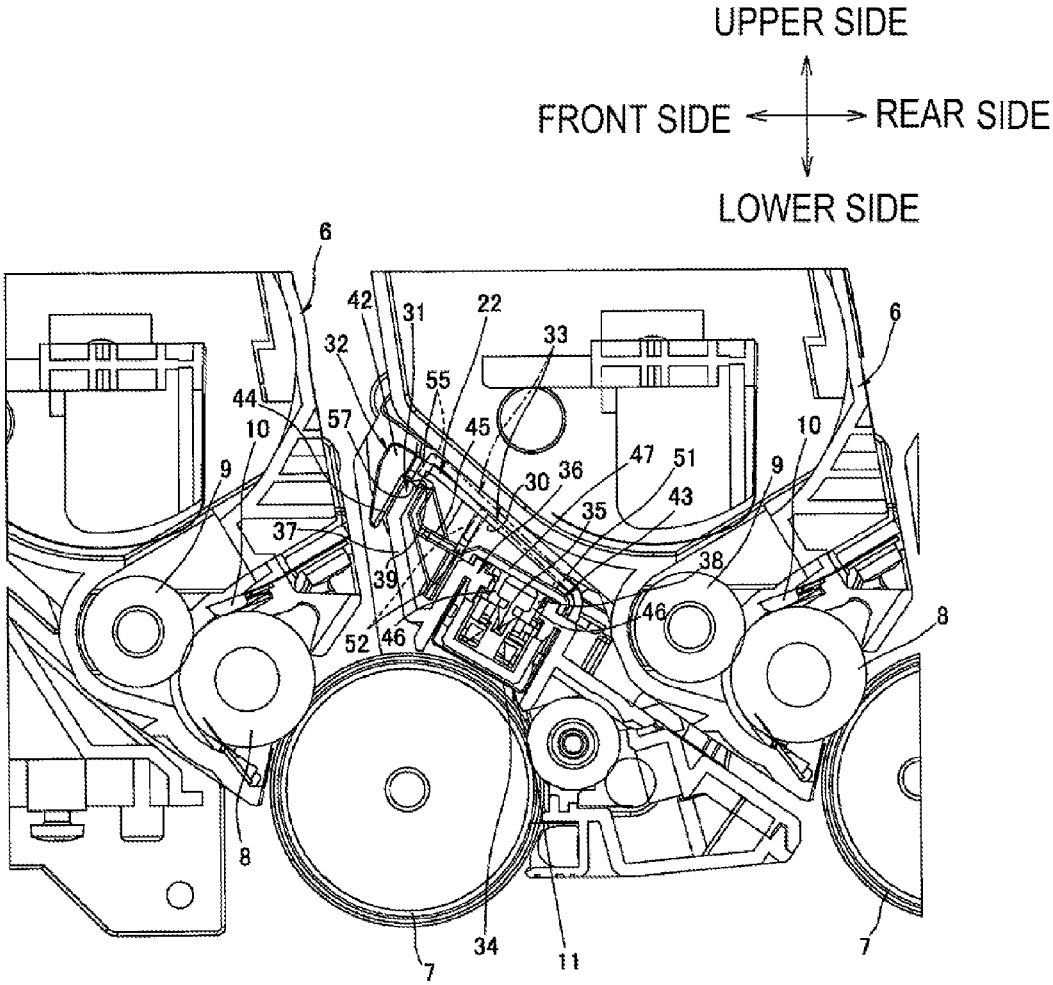
FIG. 3 is a cross-sectional view illustrating a main portion of the processing unit shown in FIG. 1.

As shown in FIGS. 3 and 4, the plurality of charging units 22 are disposed to face the rear sides of the plurality of photosensitive drums 7, respectively, and extend between the two side plates 23. For example, a space defined by the front beam 25, the rear beam 26, and the pair of left and right side plates 23 is divided into four equal parts by three charging units 22 other than the rearmost charging unit 22, and the four equal parts form cartridge containing portions 27 for containing the developing cartridges 6.

In the first exemplary embodiment, a first image forming unit is configured by a photosensitive drum 7 corresponding to any one of black, yellow, and magenta, a charging unit 22 corresponding to that photosensitive drum 7, and a cartridge containing portion 27 on the front side of that photosensitive drum 7. Also, a second image forming unit is configured by a photosensitive drum 7 disposed in parallel on the rear side of the photosensitive drum 7 of the first image forming unit, a charging unit 22 corresponding to that photosensitive drum 7, and a cartridge containing portion 27 on the front side of that photosensitive drum 7.

Each of the charging unit 22 includes a supporting frame 31 that supports the scorotron type charger 11, the scorotron type charger 11, and a duct cover 33 (one example of a first wall).

The supporting frame 31 is formed in a substantially triangular tube shape extending in the left/right direction. The supporting frame 31 includes a charger supporting portion 36, and a duct wall 37 (one example of a second wall).

The charger supporting portion 36 is disposed at the upper end portion of the charging unit 22 to face the top rear side of the photosensitive drum 7 with a gap. The charger supporting portion 36 is formed in a substantially U-shaped cylinder shape as seen in the cross-sectional view such that the charger supporting portion 36 extends in the left/right direction and the lower end portion of charger supporting portion 36 is open toward the lower side. Also, at the top wall of the charger supporting portion 36, exposure opening 38 is formed.

The exposure opening 38 is formed to extend in the left/right direction and pass vertically through the top wall of the charger supporting portion 36.

The duct wall 37 is formed in a substantially plate shape extending upward from the end portion of the charger supporting portion 36 on the lower front side. The upper end edge 39 of the duct wall 37 functions as a second end edge.

The scorotron type charger 11 includes a grid 34, a charging wire 35 which is an example of a charging member, and a wire cleaner 32 for cleaning the charging wire 35.

The grid 34 is disposed in the charger supporting portion 36. The grid 34 is formed in a substantially U-shaped cylinder shape as seen in the cross-sectional view such that the grids 34 extend in the left/right direction and the upper end portion of the grid 34 is open toward the top rear side. The upper end portion of the grid 34 functions as a first opening. The grid 34 receives a voltage applied from a power supply (not shown) of the main body casing 2.

The charging wire 35 is disposed in the grid 34 to face the lower side of the exposure opening 38. The charging wire 35 is formed in a substantially straight line shape extending in the left/right direction. The charging wire 35 receives a voltage from the power supply (not shown) of the main body casing 2.

Figure 5:
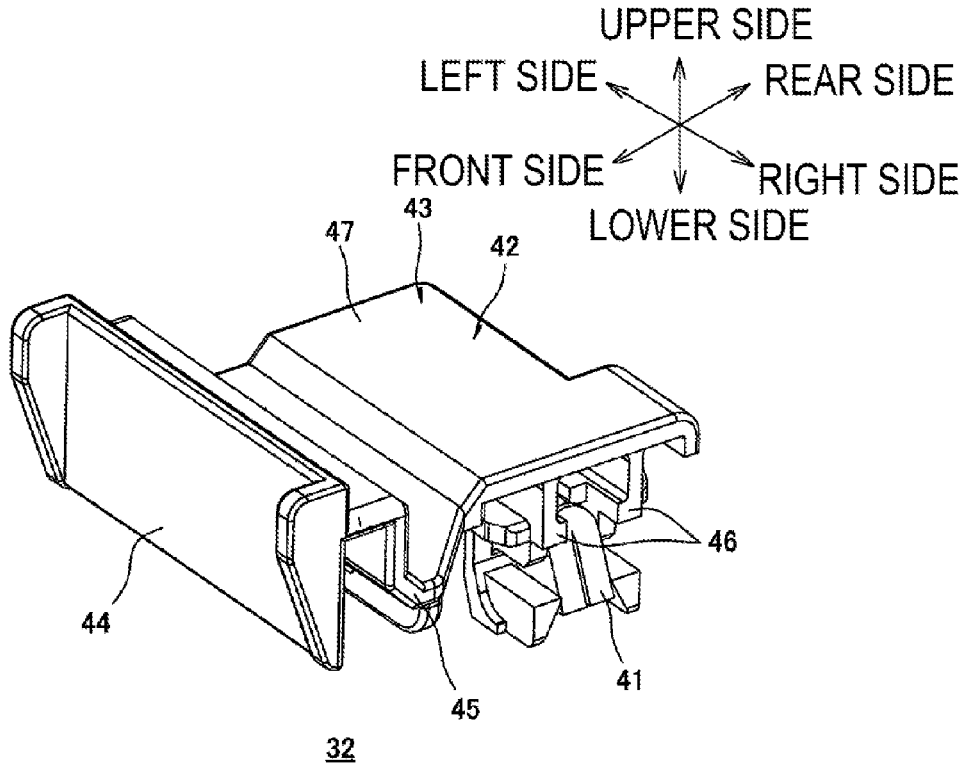
FIG. 5 is a perspective view illustrating a wire cleaner shown in FIG. 4 as seen from the top front side.

As shown in FIG. 5, the wire cleaner 32 includes an operating member 42 for operating the corresponding wire cleaner 32, and a cleaning member 41 for cleaning a corresponding charging wire 35.

The operating member 42 includes a cleaning-member supporting portion 43 that supports the cleaning member 41, an operating portion 44 for allowing a user to operate, and a connecting portion 45 that connects the operating portion 44 and the cleaning-member supporting portion 43.

The cleaning-member supporting portion 43 is provided at the rear end portion of the wire cleaner 32. The cleaning-member supporting portion 43 includes a base portion 47 and a pair of sandwiching portions 46.

The base portion 47 is formed in a substantially plate shape extending in the front/rear direction.

The two sandwiching portions 46 are disposed to face each other with a gap in the front/rear direction, and are formed as ridges extending downward from the bottom of the base portion 47.

The operating portion 44 is provided at the front end portion of the wire cleaner 32. The operating portion 44 is formed in a substantially plate shape extending in the vertical direction.

The connecting portion 45 is provided between the cleaning-member supporting portion 43 and the operating portion 44. The connecting portion 45 is formed in a substantially curved plate shape extending in the front/rear direction. Specifically, the front half of the connecting portion 45 is formed in a substantially plate shape extending in the front/rear direction, and the rear half of the connecting portion 45 is formed in a substantially U shape as seen in the side view such that the upper side of the rear half is open. Further, the front end portion of the connecting portion 45 is connected to the rear surface of the operating portion 44, and the rear end portion of the connecting portion 45 is connected to the front end portion of the base portion 47 of the cleaning-member supporting portion 43.

The cleaning member 41 is interposed between the two sandwiching portions 46. The cleaning member 41 is made of a porous member such as sponge or non-woven fabric such as felt. The cleaning member 41 is formed in a substantially clamshell plate shape so as to sandwich the charging wire 35.

Further, the wire cleaner 32 is supported at the upper end portion of the supporting frame 31, such that the front half of the connecting portion 45 faces the upper end edge 39 of the duct wall 37 from the upper side and the operating portion 44 faces the upper end portion of the duct wall 37 from the front side.

The wire cleaner 32 is movable between a standby position (see FIG. 7A) where the wire cleaner 32 is disposed at the left end portion of the supporting frame 31 and a cleaning position (see FIGS. 7B and 7C) on the right side relative to the standby position.

The wire cleaner 32 is disposed at the standby position when the wire cleaner 32 is not operated to clean the charging wire 35.

Figure 6:
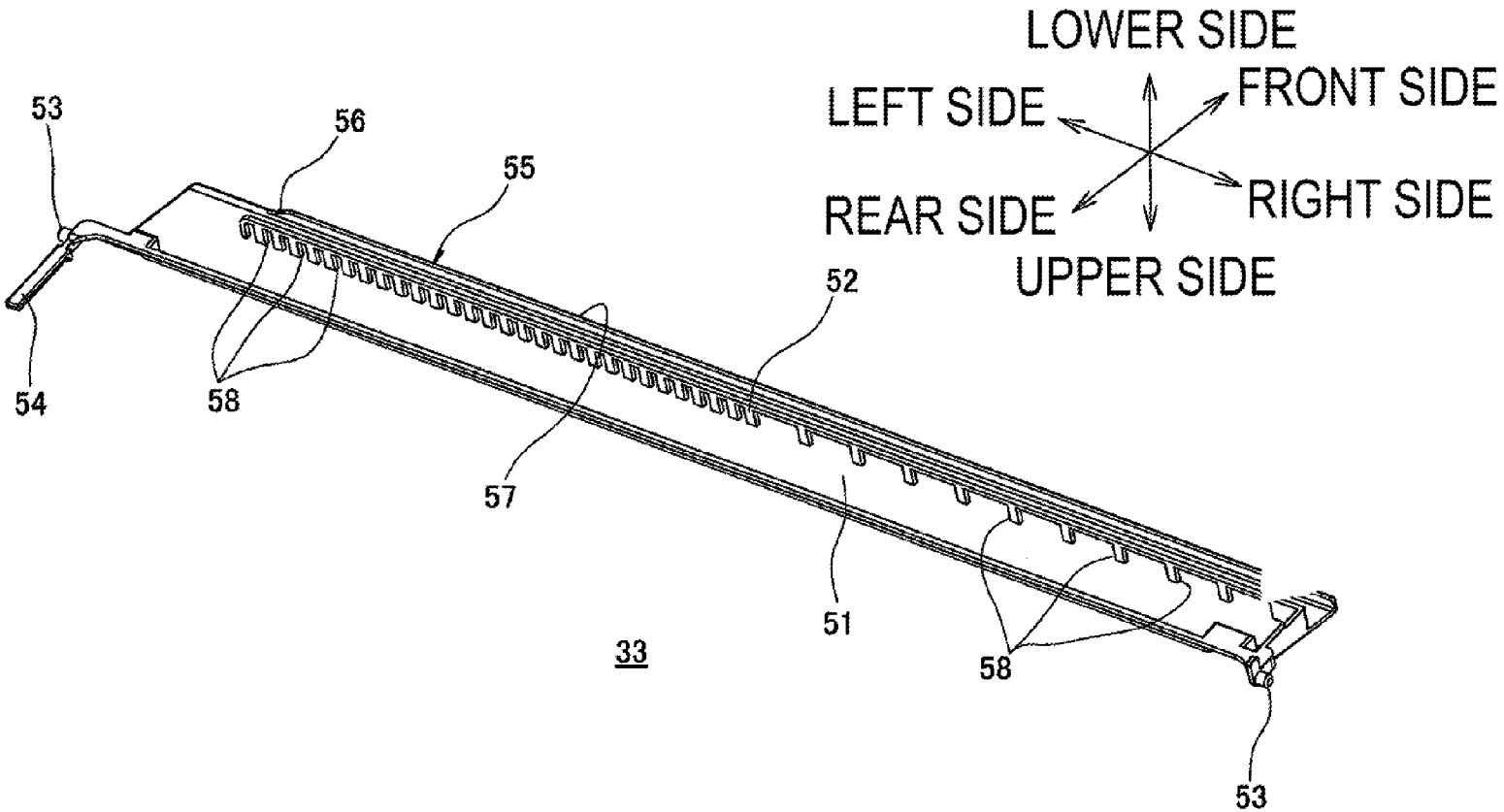
FIG. 6 is a perspective view illustrating a duct cover shown in FIG. 4 as seen from a lower rear side.

As shown in FIGS. 3 and 6, the duct cover 33 is disposed at the upper end portion of the charging unit 22 to face the upper side of the charger supporting portion 36 of the supporting frame 31 with a gap. The duct cover 33 integrally includes a covering portion 51, a pair of left and right supporting bosses 53, an elastic portion 54 which is an example of a pressing member, a flow aligning portion 52 which is an example of a flow aligning member, and a facing portion 55.

The covering portion 51 is formed in a substantially plate shape extending in the left/right direction. The front end portion of the covering portion 51 faces the upper end portion of the duct wall 37. Also, the rear end portion of the covering portion 51 faces the rear end portion of the charger supporting portion 36. Further, the length of the covering portion 51 in the left/right direction is substantially the same as the length of the supporting frame 31 in the left/right direction.

The paired supporting bosses 53 are provided at both end portions of the rear end portion of the covering portion 51 in the left/right direction, respectively. The supporting bosses 53 are formed in a substantially cylindrical shape extending from the end portions of the covering portion 51 in the left/right direction, outward in the left/right direction.

The elastic portion 54 is formed in a substantially plate shape that is electrically deformable such that the elastic portion 54 extends from the left rear end portion of the covering portion 51 toward the rear side.

The flow aligning portion 52 is formed as a ridge protruding downward from an intermediate position of the covering portion 51 in the front/rear direction and extending in the left/right direction. The right end edge of the flow aligning portion 52 is disposed to overlap the right end edge of the covering portion 51 in the vertical direction. The left end edge of the covering portion 51 is disposed on the right side relative to the left end edge of the covering portion 51. In other words, the flow aligning portion 52 is not formed at the left end edge of the covering portion 51. Also, at the flow aligning portion 52, a plurality of venting holes 58 is formed.

The plurality of venting holes 58 is formed in a substantially rectangular shape as seen in the front view, and is disposed in parallel with intervals in the left/right direction. Incidentally, the lengths of venting holes 58 formed at the right half of the flow aligning portion 52 are longer than the lengths of venting holes 58 formed at the left half of the flow aligning portion 52.

The facing portion 55 is formed as a ridge protruding downward from the front end edge of the covering portion 51 and extending in the left/right direction. The right end edge of the facing portion 55 is disposed to overlap the right end edge of the covering portion 51 in the vertical direction. The left end edge 56 of the facing portion 55 is disposed on the right side relative to the left end edge of the covering portion 51. In other words, the facing portion 55 is not formed at the left end portion of the covering portion 51. Also, the left end edge 56 of the facing portion 55 is inclined toward the lower side as from the left side to the right side. Incidentally, the lower end edge 57 of the facing portion 55 functions as a first end edge.

The paired supporting bosses 53 support the duct cover 33 at both end portions of the supporting frame 31 in the left/right direction, respectively, such that the duct cover 33 is rotatable.

Therefore, the duct cover 33 is rotatable on its rear end portion between an abutting position (see FIG. 7A) where the lower end edge 57 of the facing portion 55 abuts on the upper end edge 39 of the duct wall 37 and a separation position (see FIGS. 7B and 7C) where the lower end edge 57 of the facing portion 55 is separated upward from the upper end edge 39 of the duct wall 37.

The elastic portion 54 of the duct cover 33 is fixed to the left end portion of the supporting frame 31.

Therefore, at least when the duct cover 33 is disposed at the separation position, the duct cover 33 is pressed toward the abutting position by the elasticity of the elastic portion 54.

Figure 7A:
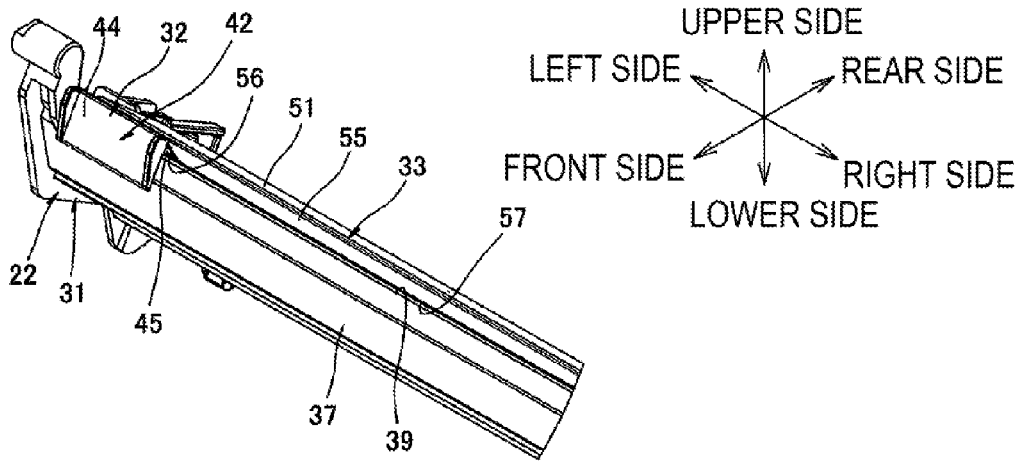

On the other hand, as shown in FIG. 7A, when the wire cleaner 32 is disposed at the standby position, the duct cover 33 is disposed at the abutting position.

At this time, the left end portion (e.g., a portion where the flow aligning portion 52 and the facing portion 55 are not formed) of the duct cover 33 faces the cleaning-member supporting portion 43 and the connecting portion 45 of the wire cleaner 32 from the upper side.

Further, the left end edge 56 of the facing portion 55 of the duct cover 33 faces the front half of the connecting portion 54 of the wire cleaner 32 from the right side.

Furthermore, the flow aligning portion 52 of the duct cover 33 is disposed on the left side of the connecting portion 45 of the wire cleaner 32 so as to overlap the connecting portion 45 of the wire cleaner 32 as seen from the left/right direction.

The duct cover 33, the duct wall 37, and the charger supporting portion 36 define a duct 30 (one example of a venting portion).

When the developing cartridge 6 is installed in the cartridge containing portion 27, as shown in FIG. 3, the developing cartridge 6 faces the operating portion 44 of the wire cleaner 32 from the front side, such that the operating member 42 of the wire cleaner 32 becomes inoperable.

3. Cleaning of Charging Wire

In order to clean a charging wire 35, first, a developing cartridge 6 of a color corresponding to a scorotron type charger 11 which is a cleaning object is removed from the drum unit 5. In the first exemplary embodiment, the scorotron type charger 11 corresponding to the black photosensitive drum 7K is set as the cleaning object.

In this case, as shown in FIG. 4, the operating member 42 is exposed to be operable in the cartridge containing portion 27.

The wire cleaner 32 slides from the standby position to the right side.

Then, the connecting portion 45 of the wire cleaner 32 abuts on the left end edge 56 of the facing portion 55 of the duct cover 33 from the left side.

Figure 7B:
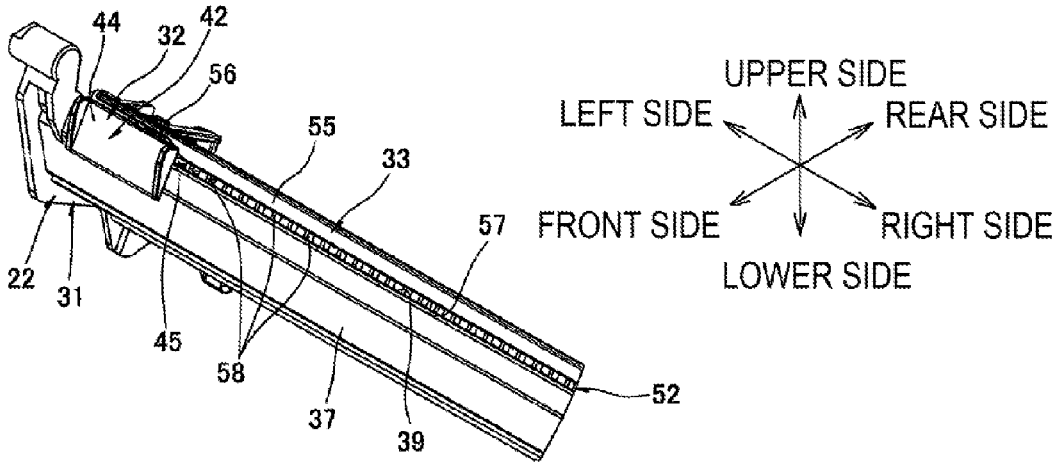

Next, as shown in FIG. 7B, when the wire cleaner 32 slides further to the right side, the connecting portion 45 of the wire cleaner 32 presses the left end edge 56 of the facing portion 55 of the duct cover 33 from the upper side. In other words, the connecting portion 45 of the wire cleaner 32 also functions as a pressing portion.

In this case, the duct cover 33 is disposed at the separation position so as to run on the connecting portion 45 of the wire cleaner 32 according to the inclination of the left end edge 56 of the facing portion 55 against the elasticity of the elastic portion 54 of the duct cover 33.

At this time, a gap between the lower end edge 57 of the facing portion 55 and the upper end edge 39 of the duct wall 37 functions as a second opening. In other words, the second opening is defined by the lower end edge 57 of the facing portion 55 and the upper end edge 39 of the duct wall 37 when the duct cover 33 is disposed at the separation position.

Also, as shown by an alternate long and two short dashes line in FIG. 3, the flow aligning portion 52 is disposed on the upper side of the connecting portion 45 of the wire cleaner 32, so as not to overlap the connecting portion 45 of the wire cleaner 32 as seen from the left/right direction.

Figure 7C:
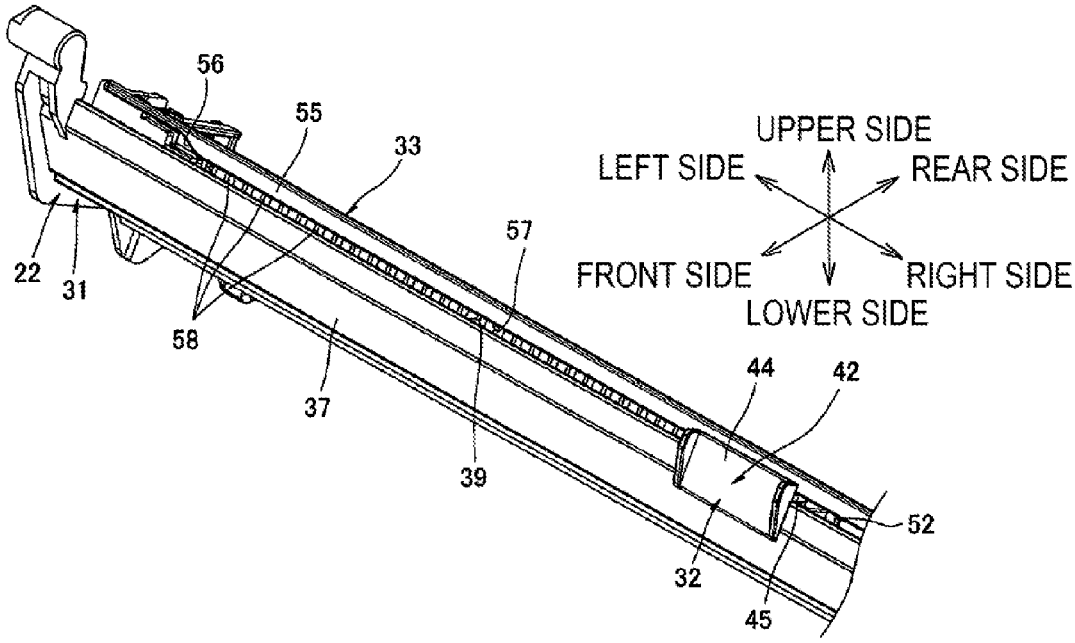

Next, as shown in FIG. 7C, when the wire cleaner 32 is made slide further to the right side, the wire cleaner 32 slides to the right side such that the connecting portion 45 passes between the lower end edge 57 of the facing portion 55 and the upper end edge 39 of the duct wall 37.

In this case, the wire cleaner 32 slides such that the connecting portion 45 slides on the upper end edge 39 of the duct wall 37. In other words, the upper end edge 39 of the duct wall 37 guides the sliding of the wire cleaner 32.

Further, when the wire cleaner 32 is made slide to the right side as described above, the cleaning member 41 slides to the right side according to the sliding of the wire cleaner 32.

Therefore, the surface of the charging wire 35 is cleaned by the cleaning member 41.

Thereafter, when the wire cleaner 32 returns to the standby position, the abutting of the duct cover 33 and the connecting portion 45 of the wire cleaner 32 is released.

Then, the duct cover 33 moves back to the abutting position by the elasticity of the elastic portion 54.

4. Advantages (1) According to the drum unit 5, as shown in FIGS. 2 and 4, for example, the operating portion 44 of the wire cleaner 32 of the scorotron type charger 11 corresponding to the black photosensitive drum 7K (one example of the first photosensitive member) is exposed to be operable when the developing cartridge 6 corresponding to the black photosensitive drum 7K is removed from the cartridge containing portion 27.

In other words, by removing a developing cartridge 6 corresponding to a photosensitive drum 7 corresponding to a scorotron type charger 11 which is a cleaning object, it is possible to clean the charging wire 35 of that scorotron type charger 11.

As a result, it is possible to easily clean the charging wire 35 as compared to a case of removing a developing cartridge 6 corresponding to a photosensitive drum 7 that is different from the photosensitive drum 7 corresponding to the scorotron type charger 11 which is the cleaning object so as to clean the charging wire 35.

(2) According to the drum unit 5, as shown in FIG. 3, when the developing cartridge 6 is installed in the cartridge containing portion 27, the operating portion 44 of the wire cleaner 32 faces the developing cartridge 6.

Therefore, it is possible to certainly expose the operating portion 44 by removing the developing cartridge 6 from the cartridge containing portion 27.

(3) According to the drum unit 5, as shown in FIG. 3, the charging unit 22 includes the duct 30 (e.g., the space defined by the duct cover 33, the duct wall 37, and the charger supporting portion 36) that is connected to the upper end portion of the grid 34.

Therefore, it is possible to make air act on the scorotron type charger 11 through the duct 30.

In this way, it is possible to remove ozone staying in the vicinity of the scorotron type charger 11 through the duct 30, and to efficiently charge the photosensitive drum 7.

(4) According to the drum unit 5, as shown in FIGS. 3 and 7A to 7C, the connecting portion 45 of the wire cleaner 32 may be disposed in the duct 30.

Therefore, it is possible to use the duct 30 to efficiently dispose the connecting portion 45 of the wire cleaner 32.

(5) According to the drum unit 5, as shown in FIG. 7A, when the operating member 42 is disposed at the standby position, it is possible to close the second opening (e.g., the gap between the lower end edge 57 of the facing portion 55 of the duct cover 33 and the upper end edge 39 of the duct wall 37). Also, as shown in FIG. 7B, it is possible to open the second opening at the same time as the operating member 42 moves from the standby position to the operation position.

Therefore, unless the cleaning of the charging wire 35 is performed, it is possible to maintain the sealability of the duct 30. Also, when the cleaning of the charging wire 35 is performed, it is possible to secure the movement path of the connecting portion 45.

(6) According to the drum unit 5, as shown in FIG. 7A, when the operating member 42 is disposed at the standby position, it is possible to abut the lower end edge 57 of the facing portion 55 of the duct cover 33 on the upper end edge 39 of the duct wall 37, thereby closing the second opening. Also, as shown in FIG. 7B, it is possible to separate the lower end edge 57 of the facing portion 55 of the duct cover 33 from the upper end edge 39 of the duct wall 37 at the same time as the operating member 42 moves from the standby position to the operation position, thereby opening the second opening.

Therefore, it is possible to move the duct cover 33 to the separation position by making use of the movement of the operating member 42 from the standby position to the cleaning position.

As a result, when the cleaning of the charging wire 35 is performed, it is possible to certainly open the second opening and secure the movement path of the connecting portion 45.

(7) According to the drum unit 5, as shown in FIG. 7B, when the operating member 42 moves from the standby position to the operation position, the connecting portion 45 of the operating member 42 presses the lower end edge 57 of the facing portion 55 of the duct cover 33, thereby separating the lower end edge 57 from the upper end edge 39 of the duct wall 37.

Therefore, it is possible to certainly separate the lower end edge 57 of the facing portion 55 of the duct cover 33 from the upper end edge 39 of the duct wall 37 by the connecting portion 45.

As a result, when the cleaning of the charging wire 35 is performed, it is possible to more certainly open the second opening and secure the movement path of the connecting portion 45.

(8) According to the drum unit 5, as shown in FIGS. 7A to 7C, it is possible to use the upper end edge 39 of the duct wall 37 to guide the operating member 42. Therefore, it is possible to improve the operability of the operating member 42 without increasing the number of components.

(9) According to the drum unit 5, as shown by the alternate long and two short dashes line in FIG. 3, when the duct cover 33 is disposed at the separation position, the flow aligning portion 52 of the duct cover 33 is disposed on the upper side of the connecting portion 45, so as not to overlap the connecting portion 45 as seen from the left/right direction.

Therefore, it is possible to use the flow aligning portion 52 to align an air flow in the duct 30, and to dispose the flow aligning portion 52 on the upper side of the connecting portion 45 so as not to interfere with the connecting portion 45 when the operating member 42 is operated.

As a result, it is possible to align the air flow in the duct 30 while ensure the operability of the operating member 42.

(10) According to the drum unit 5, as shown in FIG. 6, the duct cover 33 includes the elastic portion 54 which presses the duct cover 33 toward the duct wall 37.

Therefore, when the operating member 42 is disposed at the standby position, it is possible to certainly dispose the duct cover 33 at the abutting position.

5. Second Exemplary Embodiment

A second exemplary embodiment of the drum unit 5 will be described with reference to FIGS. 8A to 8C. In the second exemplary embodiment, members identical to those of the first exemplary embodiment are denoted by the same reference symbols, and will not be described.

(1) Configuration of Second Exemplary Embodiment

In the above-described first exemplary embodiment, the duct cover 33 is configured to be movable between the abutting position where the duct cover 33 abuts on the duct wall 37 and the separation position where the duct cover 33 is separated from the duct wall 37.

Figure 8A:
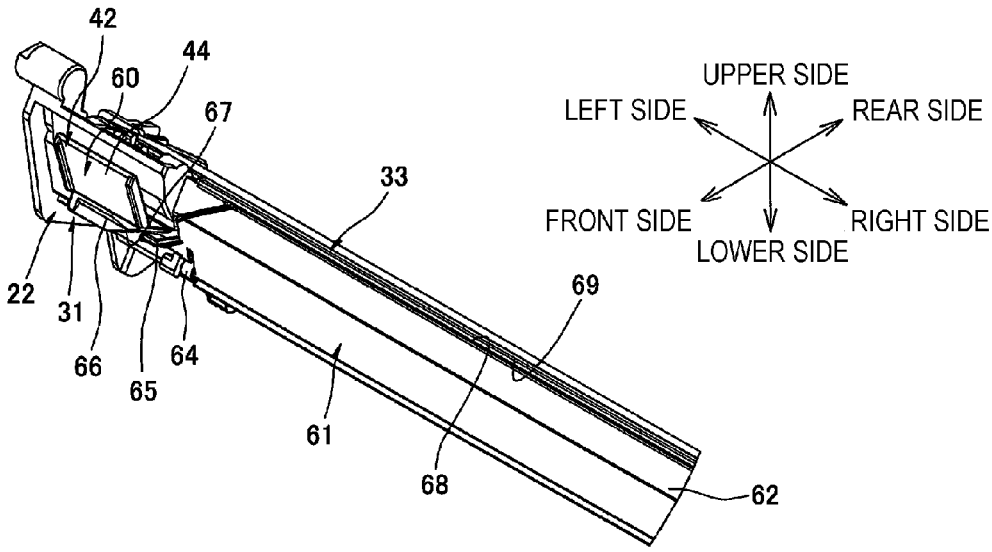
Figure 8B:
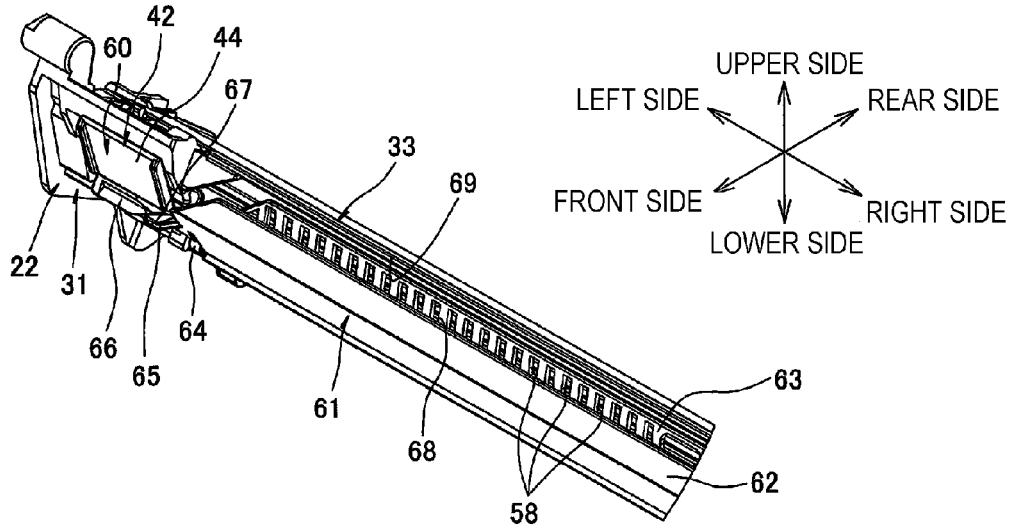
Figure 8C:
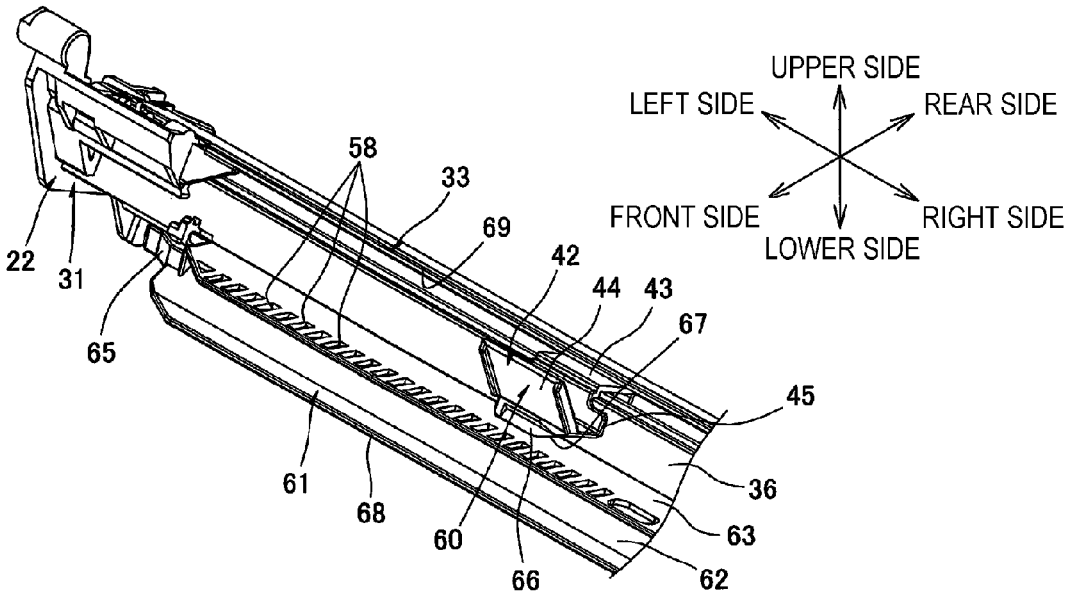

In contrast, in the second exemplary embodiment, a duct wall 61 is configured to be movable between an abutting position where the duct wall 61 abuts on the duct cover 33 (see FIG. 8A) and a separation position where the duct wall 61 is separated from the duct cover 33 (see FIGS. 8B and 8C). In the following description, when the direction of the duct wall 61 is referred to, the direction is based on a state where the duct wall 61 is disposed at the abutting position.

In the second exemplary embodiment, an operating portion 44 of a wire cleaner 60 includes an abutting portion 66 (one example of a pressing portion) which abuts on an abutted portion 65 (to be described below) of the duct wall 61.

The abutting portion 66 is formed as a ridge, which protrudes downward from the lower end portion of the operating portion 44 of the wire cleaner 60 and extends in the left/right direction. The right end edge 67 of the abutting portion 66 is inclined toward the front side as from the right side to the left side.

As shown in FIGS. 8A and 8C, the duct wall 61 is disposed to face the front side of the charger supporting portion 36 of the supporting frame 31 with a gap. The duct wall 61 is formed in a substantially U-shaped cylinder shape as seen in the cross-sectional view such that the duct wall 61 extends in the left/right direction and the upper end portion duct wall 61 is open toward the upper side. More specifically, the duct wall 61 integrally includes a covering portion 62, a flow aligning portion 63 (one example of the flow aligning member), and the abutted portion 65.

The covering portion 62 is formed in a substantially plate shape extending in the left/right direction, and constitutes the front wall of the duct wall 61. Also, the length of the covering portion 62 in the left/right direction is shorter than the length of the supporting frame 31 in the left/right direction.

The flow aligning portion 63 is disposed to face the rear side of the covering portion 62 with a gap. The flow aligning portion 63 is formed in a substantially plate shape extending in the left/right direction, and constitutes the rear wall of the duct wall 61. Incidentally, the lower end portion of the flow aligning portion 63 and the lower end portion of the covering portion 62 are connected by the bottom wall (not shown) of the duct wall 61. Further, at the flow aligning portion 63, like in the above-described first exemplary embodiment, a plurality of venting holes 58 is formed.

The abutted portion 65 is formed in a substantially rod shape protruding from the left end portion of the lower end portion of the duct wall 61 toward the left side. Specifically, the abutted portion 65 is contiguous to the left end portion of the lower end portion of the duct wall 61, extends to be inclined toward the lower side as from the right side to the left side, is bent to the left side at a left end portion thereof, and extends to the left side.

Further, the lower end portion of the duct wall 61 is supported by the supporting frame 31 such that the duct wall 61 is rotatable.

Therefore, the duct wall 61 is rotatable on a lower end portion thereof between an abutting position (see FIG. 8A) where the upper end edge 68 of the covering portion 62 abuts on the front end edge 69 of the duct cover 33 and a separation position (see FIGS. 8B and 8C) where the upper end edge 68 of the covering portion 62 is separated from the front end edge 69 of the duct cover 33 toward the front side.

At both end portions of the lower end portion of the duct wall 61 in the left/right direction, coil springs 64 are supported as examples of the pressing member, one by one. One-side end portions of the coil springs 64 are locked by the duct wall 61, and the other-side end portions of the coil springs 64 are locked by the supporting frame 31.

Therefore, the duct wall 61 is always pressed toward the abutting position by the pressing forces of the coil springs 64.

As shown in FIG. 8A, when the wire cleaner 60 is disposed at the standby position, the duct wall 61 is disposed at the abutting position.

In this case, the flow aligning portion 63 of the duct wall 61 faces the left side of the connecting portion 45 of the wire cleaner 60. In other words, the flow aligning portion 63 of the duct wall 61 overlaps the connecting portion 45 of the wire cleaner 60 as seen from the left/right direction.

Also, the abutting portion 66 of the wire cleaner 60 faces the abutted portion 65 of the duct wall 61 from the left side.

(2) Cleaning of Charging Wire in Second Exemplary Embodiment

Like in the above-described first exemplary embodiment, when the wire cleaner 60 slides from the standby position to the right side, the abutting portion 66 of the wire cleaner 60 abuts on the abutted portion 65 of the duct wall 61 from the left side.

Next, as shown in FIG. 8B, when the wire cleaner 60 slides further to the right side, the abutting portion 66 of the wire cleaner 60 presses the abutted portion 65 of the duct wall 61 toward the front side.

Then, the duct wall 61 is separated so as to run on the abutting portion 66 of the wire cleaner 60 against the pressing forces of the coil springs 64.

Next, as shown in FIG. 8C, when the wire cleaner 60 slides further to the right side, the duct wall 61 rotates to be inclined toward the front side, and is disposed at the separate position.

In this case, the flow aligning portion 63 is disposed on the lower front side of the operating portion 44 of the wire cleaner 60. In other words, the flow aligning portion 63 does not overlap the connecting portion 45 of the wire cleaner 60 as seen from the left/right direction.

A gap between the front end edge 69 of the duct cover 33 and the upper end edge 68 of the duct wall 61 functions as the second opening. In other words, when the duct wall 61 is disposed at the separation position, the second opening is defined by the front end edge 69 of the duct cover 33 and the upper end edge 68 of the duct wall 61.

Next, when the wire cleaner 60 slides further to the right side, the wire cleaner 60 slides to the right side so as to pass between the front edge 69 of the duct cover 33 and the upper end edge 68 of the duct wall 61.

When the wire cleaner 60 slides to the right side as described above, the cleaning member 41 slides to the right side according to the sliding of the wire cleaner 60.

Therefore, the surface of the charging wire 35 is cleaned by the cleaning member 41.

Thereafter, when the wire cleaner 60 returns to the standby position, the duct wall 61 moves back to the abutting position by the pressing forces of the coil springs 64.

(3) Advantages of Second Exemplary Embodiment (3-1) According to the drum unit 5 of the second exemplary embodiment, as shown in FIG. 8A, when the operating member 42 is disposed at the standby position, it is possible to abut the upper end edge 68 of the covering portion 62 of the duct wall 61 on the front end edge 69 of the duct cover 33, thereby closing the second opening. Further, as shown in FIG. 8B, it is possible to separate the upper end edge 68 of the covering portion 62 of the duct wall 61 from the front end edge 69 of the duct cover 33 at the same time as the operating member 42 moves from the standby position to the cleaning position, thereby opening the second position.

Therefore, it is possible to use the movement of the operating member 42 from the standby position to the cleaning position to move the duct wall 61 to the separation position.

As a result, when the cleaning of the charging wire 35 is performed, it is possible to certainly open the second opening and secure the movement path of the connecting portion 45.

(3-2) According to the drum unit 5 of the second exemplary embodiment, as shown in FIG. 8B, when the operating member 42 moves from the standby position to the cleaning position, the abutting portion 66 of the operating member 42 presses the abutted portion 65 of the duct wall 61 toward the front side.

Therefore, it is possible to certainly separate the duct wall 61 from the duct cover 33 by the abutting portion 66 of the operating member 42.

As a result, when the cleaning of the charging wire 35 is performed, it is possible to more certainly open the second opening and secure the movement path of the connecting portion 45.

(3-3) According to the drum unit 5 of the second exemplary embodiment, as shown in FIG. 8C, when the duct wall 61 is disposed at the separation position, the flow aligning portion 63 of the duct wall 61 is disposed on the lower front side of the wire cleaner 32 so as not to overlap the connecting portion 45 as seen from the left/right direction.

Therefore, it is possible to align the air flow in the duct 30 by the flow aligning portion 63 and to dispose the flow aligning portion 63 on the lower front side of the wire cleaner 32 so as not to interfere with the connecting portion 45 when the operating member 42 is operated.

As a result, it is possible to align the air flow in the duct 30 while ensuring the operability of the operating member 42.

(3-4) According to the drum unit 5 of the second exemplary embodiment, as shown in FIG. 8A, the coil springs 64 may be provided to press the duct wall 61 toward the duct cover 33.

Therefore, when the operating member 42 is disposed at the standby position, it is possible to certainly dispose the duct cover 33 at the abutting position.

(3-5) Even in the drum unit 5 of the second exemplary embodiment, it is possible to achieve the same effects as those of the above-described first exemplary embodiment.

6. Third Exemplary Embodiment

A third exemplary embodiment of the drum unit 5 will be described with reference to FIGS. 9A and 9B. Incidentally, in the third exemplary embodiment, members identical to those of the first exemplary embodiment are denoted by the same reference symbols, and will not be described.

Figure 9A:
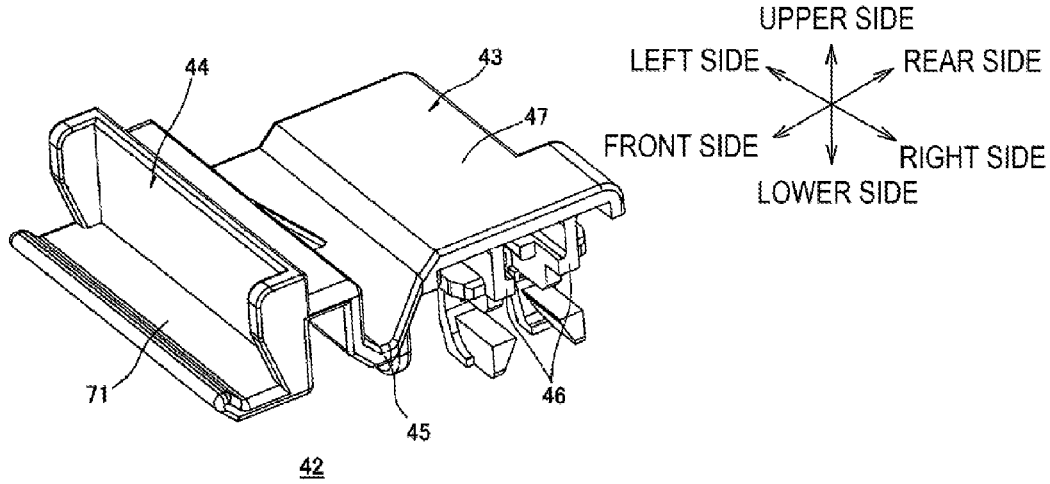

In the third exemplary embodiment, as shown in FIG. 9A, a protruding portion 71 is provided to the operating portion 44 of the above-described first exemplary embodiment.

The protruding portion 71 is formed as a ridge protruding from the lower end portion of the operating portion 44 toward the front side and extending in the left/right direction.

Figure 9B:
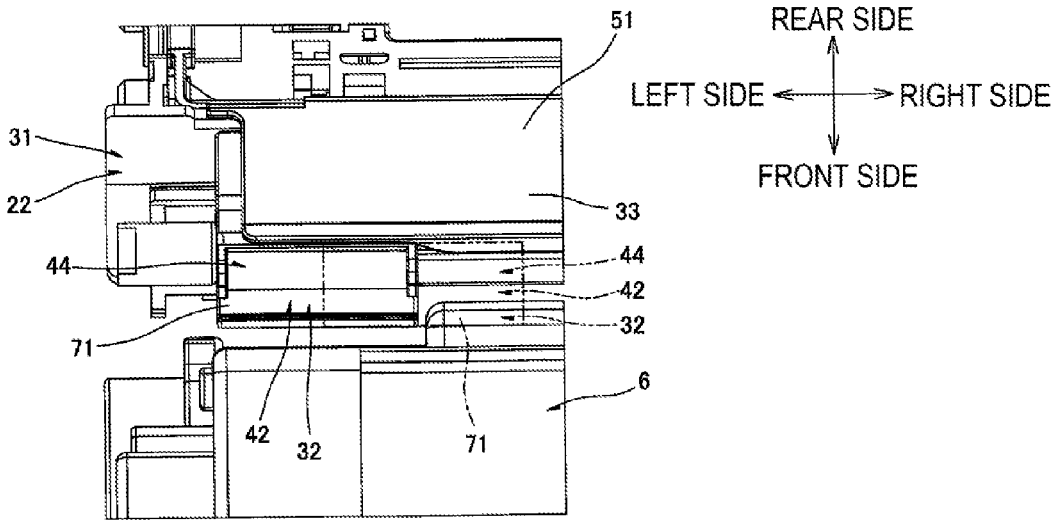

Also, as shown by an alternate long and two short dashes line in FIG. 9B, when the operating member 42 is disposed on the right side relative to the standby position, the protruding portion 71 interferes with the developing cartridge 6.

According to the drum unit 5 of the third exemplary embodiment, when the operating member 42 is operated, it is possible to put a finger on the protruding portion 71.

Therefore, it is possible to prevent erroneous contact with the photosensitive drum 7 or the like during the operating of the operating member 42.

As a result, it is possible to easily and certainly operate the operating portion 44.

Also, according to the drum unit 5 of the third exemplary embodiment, as shown by the alternate long and two short dashes line in FIG. 9B, in a state where the operating member 42 is not disposed at the standby position, since the developing cartridge 6 and the protruding portion 71 interfere with each other, it is impossible to install the developing cartridge 6 into the cartridge containing portion 27.

Therefore, in the state where the operating member 42 is not disposed at the standby position, it is possible to suppress the developing cartridge 6 from being installed into the cartridge containing portion 27.

As a result, when the developing cartridge 6 is installed into the cartridge containing portion 27, it is possible to certainly dispose the operating member 42 at the standby position.

Further, even in the drum unit 5 of the third exemplary embodiment, it is possible to achieve the same effects as those of the above-described first exemplary embodiment.

7. Fourth Exemplary Embodiment

A fourth exemplary embodiment of the drum unit 5 will be described with reference to FIGS. 10A and 10B. Incidentally, in the fourth exemplary embodiment, members identical to those of the first exemplary embodiment are denoted by the same reference symbols, and will not be described.

In the above-described first exemplary embodiment, when the duct cover 33 is disposed at the separation position, the lower end edge 57 of the facing portion 55 is separated from the upper end edge 39 of the duct wall 37, whereby the second opening is formed.

Figure 10A:
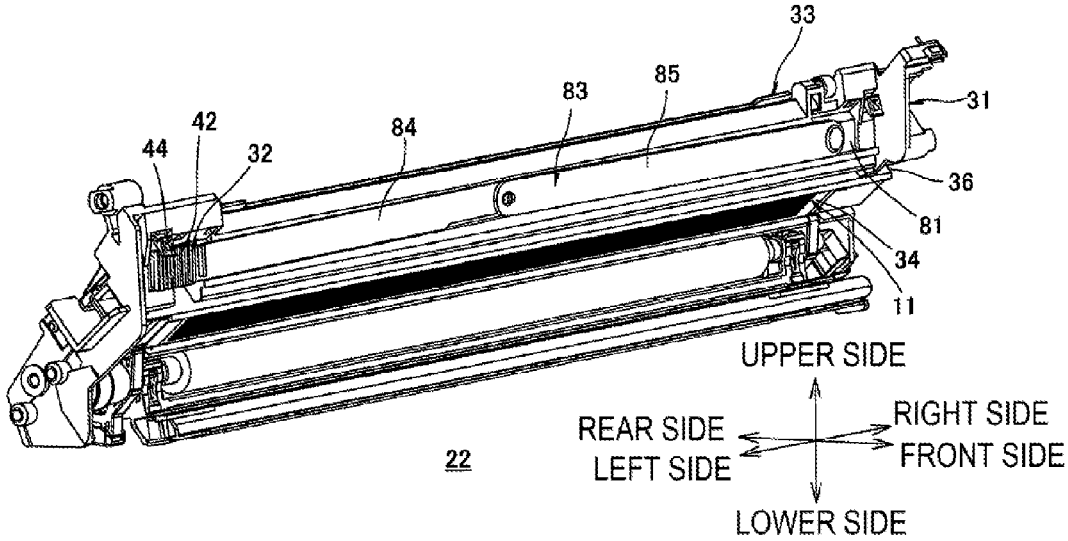
Figure 10B:
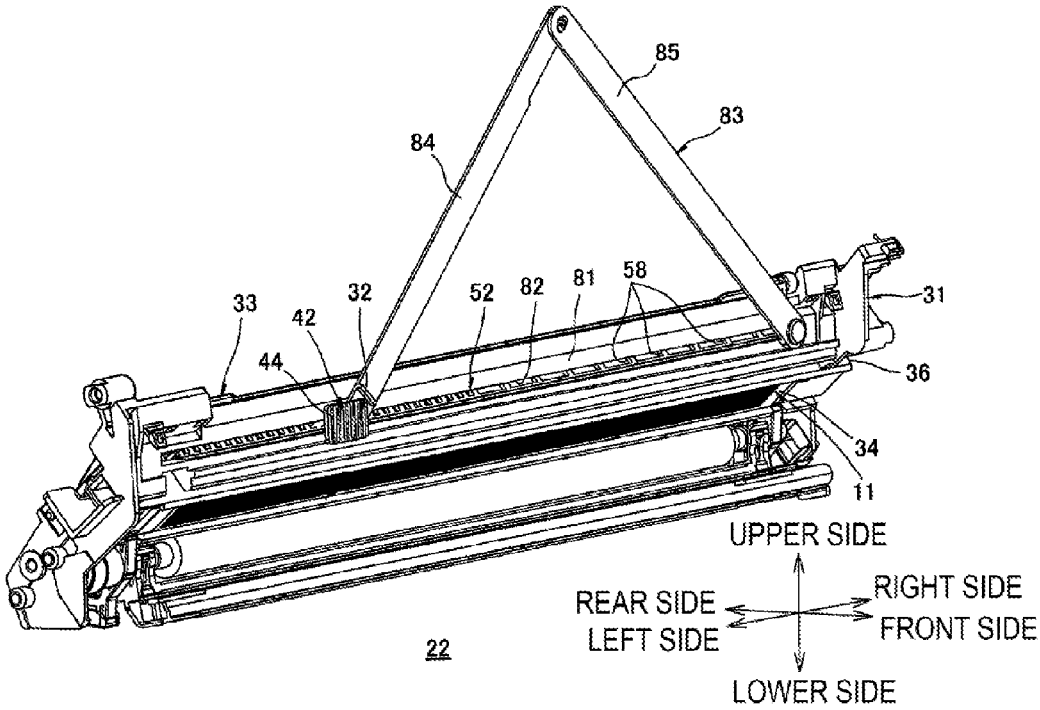

In contrast, in the fourth exemplary embodiment, as shown in FIG. 10B, at a duct wall 81 (one example of a wall portion), a duct opening 82 is formed as an example of the second opening. Also, at the duct wall 81, a duct shutter 83 is provided as an example of an opening/closing member for opening and closing the duct opening 82.

The duct opening 82 is formed in a substantially straight line shape extending in the left/right direction, so as to pass through the duct wall 81 in the front/rear direction.

The duct shutter 83 is formed in a substantially rod shape extending in the left/right direction and capable of being bent almost at the center in the left/right direction. Specifically, the duct shutter 83 includes a first shutter member 84 and a second shutter member 85 which are connected to each other.

The first shutter member 84 configures the left half of the duct shutter 83, and is formed in a substantially rod shape extending in the left/right direction.

The second shutter member 85 configures the right half of the duct shutter 83, and is formed in a substantially rod shape extending in the left/right direction.

Further, the right end portion of the first shutter member 84 and the left end portion of the second shutter member 85 are connected to be rotatable on each other.

Also, the left end portion of the first shutter member 84 is connected to the operating portion 44 of the wire cleaner 32 such that the duct shutter 83 is rotatable on the operating portion 44. Further, the right end portion of the second shutter member 85 is connected to the duct wall 81 on the right side of the duct opening 82 such that the duct shutter 83 is rotatable on the duct wall 81 on the right side of the duct opening 82.

As shown in FIG. 10A, when the wire cleaner 60 is disposed at the standby position, the duct shutter 83 stretches such that the first shutter member 84 and the second shutter member 85 are arranged in a substantially straight line shape. In this case, the duct shutter 83 is disposed at the closed position where the duct shutter 83 closes the duct opening 82. When the duct shutter 83 is disposed at the closed position, the connection portion of the first shutter member 84 and the second shutter member 85 are slightly bent toward the upper side.

As shown in FIG. 10B, when the wire cleaner 60 moves from the standby position to the cleaning position, the duct shutter 83 retreats upward while being bent at the connection portion of the first shutter member 84 and the second shutter member 85. Therefore, the duct shutter 83 is disposed at the open position where the duct shutter 83 opens the duct opening 82.

According to the drum unit 5 of the fourth exemplary embodiment, it is possible to use the movement of the operating member 42 from the standby position to the cleaning position to move the duct shutter 83 from the closed position to the open position, thereby opening the duct opening 82.

Therefore, when the cleaning of the charging wire 35 is performed, it is possible to certainly open the duct opening 82 and secure the movement path of the connecting portion 45.

Further, even in the drum unit 5 of the fourth exemplary embodiment, it is possible to achieve the same effects as those of the above-described first exemplary embodiment.

What is claimed is:

1. A photosensitive member unit comprising:

a first image-forming unit comprising a first photosensitive member that is rotatable on a first axis line; and a second image-forming unit comprising a second photosensitive member that is rotatable on a second axis line parallel with the first axis line, and that is disposed in parallel with the first image-forming unit at a first side in an orthogonal direction perpendicular to the first axis line and the second axis line, wherein the first image-forming unit comprises a charger facing the first photosensitive member and defines a cartridge-containing portion that faces the first photosensitive member, wherein the first image-forming unit is configured to receive a developing cartridge in the cartridge-containing portion, wherein the cartridge-containing portion positions the developing cartridge, when received in the cartridge-containing portion, to feed developer to the first photosensitive member, wherein the charger is configured to receive a predetermined voltage and comprises:

a cleaning member configured to clean at least a portion of the charger; and an operating member configured to operate the cleaning member, wherein the operating member is inoperable when the developing cartridge is installed in the cartridge-containing portion, and wherein the operating member is exposed and operable through the cartridge-containing portion when the developing cartridge is removed from the cartridge-containing portion.

2. The photosensitive member unit according to claim 1, wherein the operating member comprises an operating portion configured to face the developing cartridge when the developing cartridge is installed in the cartridge-containing portion.

3. The photosensitive member unit according to claim 2, wherein the charger has a first opening formed across the charging member from the first photosensitive member, wherein the first image-forming unit comprises a venting portion connected to the first opening, and wherein the operating portion is disposed across the venting portion from the charger.

4. The photosensitive member unit according to claim 3, wherein the operating member comprises:

a cleaning-member supporting portion that supports the cleaning member; and a connecting portion that connects the operating portion and the cleaning-member supporting portion, and wherein the connecting portion is disposed in the venting portion.

5. The photosensitive member unit according to claim 4, wherein the operating member is configured to be movable between a standby position where the operating member is located when the operating member is not operated and a cleaning position where the operating member is located when the operating member is operated, along an axis line direction parallel with the first axis line and the second axis line, wherein the venting portion has a second opening formed to be opened toward a second side in the orthogonal direction, wherein the second opening is configured to be closed when the operating member is disposed at the standby position, and wherein the second opening is configured to be opened when the operating member moves from the standby position to the cleaning member.

6. The photosensitive member unit according to claim 5, wherein the venting portion comprises:

a first wall that comprises a first-end edge; and a second wall that comprises a second-end edge facing the first-end edge, wherein the first wall is configured to be disposed at an abutting position where the first-end edge abuts the second-end edge when the operating member is disposed at the standby position, wherein the first wall is configured to move to a separation position where the first-end edge is separated from the second-end edge when the operating member moves from the standby position to the cleaning position, and wherein the second opening is defined by the first-end edge and the second-end edge when the first wall is disposed at the separation position.

7. The photosensitive member unit according to claim 6, wherein the operating member comprises a pressing portion configured to press the first-end edge such that the first-end edge is separated from the second-end edge when the operating member moves from the standby position to the cleaning position.

8. The photosensitive member unit according to claim 6, wherein the second-end edge is configured to guide the movement of the operating member.

9. The photosensitive member unit according to claim 6, wherein the first wall comprises a flow aligning member configured to uniformize an air flow heading from the venting portion to the charger in the axis line direction, wherein the flow aligning member is configured to be disposed to overlap the connecting portion as seen from the axis line direction when the first wall is disposed at the abutting position, and wherein the flow aligning member is configured to be disposed across the connecting portion from the first photosensitive member as seen from the axis line direction when the first wall is disposed at the separation position.

10. The photosensitive member unit according to claim 6, further comprising:

a pressing member configured to press the first-end edge toward the second-end edge such that the first-end edge abuts the second-end edge.

11. The photosensitive member unit according to claim 5, wherein the venting portion comprises:

a first wall that comprises a first-end edge; and a second wall that comprises a second-end edge facing the first-end edge, wherein the second wall is configured to be disposed at an abutting position where the second-end edge abuts the first-end edge when the operating member is disposed at the standby position, wherein the second wall is configured to rotate to a separation position where the second-end edge is separated from the first-end edge when the operating member moves from the standby position to the cleaning position, and wherein the second opening is defined by the first-end edge and the second-end edge when the second wall is disposed at the separation position.

12. The photosensitive member unit according to claim 11, wherein the operating member comprises a pressing portion configured to press the second wall such that the second wall is separated from the first wall when the operating member moves from the standby position to the cleaning position.

13. The photosensitive member unit according to claim 11, wherein the second wall comprises a flow aligning member configured to uniformize an air flow heading from the venting portion to the charger in the axis line direction, wherein the flow aligning member is configured to be disposed to overlap the connecting portion as seen from the axis line direction when the second wall is disposed at the abutting position, and wherein the flow aligning member is configured to be disposed at the second side in the orthogonal direction of the connecting portion as seen from the axis line direction when the second wall is disposed at the separation position.

14. The photosensitive member unit according to claim 11, comprising:

a pressing member configured to press the second-end edge toward the first-end edge such that the second-end edge abuts the first-end edge.

15. The photosensitive member unit according to claim 5, wherein the venting portion comprises:

a wall portion, disposed at the second side in the orthogonal direction of the connecting portion, and that comprises the second opening; and an opening/closing member, connected to the operating member, and configured to open and close the second opening, and wherein the opening/closing member is configured to be disposed at a closed position where the opening/closing member closes the second opening when the operating member is disposed at the standby position, and wherein the opening/closing member moves to an open position where the opening/closing member opens the second opening when the operating member moves from the standby position to the cleaning position.

16. The photosensitive member unit according to claim 5, wherein the operating portion comprises a protruding portion that protrudes from an end portion on a first photosensitive member side of the operating portion toward the second side in the orthogonal direction.

17. The photosensitive member unit according to claim 16, wherein the protruding portion is configured to interfere with the developing cartridge when the operating member is disposed offset from the standby position.

* * * * *